US008814756B2

(12) United States Patent
Todokoro

(10) Patent No.: US 8,814,756 B2
(45) Date of Patent: Aug. 26, 2014

(54) HOUSEHOLD JUNGLE GYM

(75) Inventor: Shinji Todokoro, Tokyo (JP)

(73) Assignee: Agatsuma Co., Ltd., Tokyo (JP)

( * ) Notice: Subject to any disclaimer, the term of this patent is extended or adjusted under 35 U.S.C. 154(b) by 296 days.

(21) Appl. No.: 13/328,340

(22) Filed: Dec. 16, 2011

(65) Prior Publication Data

US 2012/0157266 A1 Jun. 21, 2012

(30) Foreign Application Priority Data

Dec. 20, 2010 (JP) ..... 2010-282631

(51) Int. Cl.
*A63B 17/04* (2006.01)
*A63B 9/00* (2006.01)

(52) U.S. Cl.
CPC ..... *A63B 9/00* (2013.01); *A63B 2009/006* (2013.01); *A63B 17/04* (2013.01); *A63B 2210/60* (2013.01); *A63B 2208/12* (2013.01)
USPC ..... 482/35; 472/116

(58) Field of Classification Search
CPC ..... A63B 9/00; A63B 17/00
USPC ..... 482/23, 35, 36; 472/116, 117, 136
See application file for complete search history.

(56) References Cited

U.S. PATENT DOCUMENTS

| | | | | |
|---|---|---|---|---|
| 1,914,555 | A * | 6/1933 | Connelly | 482/23 |
| 3,554,540 | A * | 1/1971 | Green | 482/37 |
| 5,031,605 | A * | 7/1991 | Mills | 602/36 |
| 5,306,220 | A * | 4/1994 | Kearney | 482/94 |
| 6,443,406 | B1 * | 9/2002 | Frank | 248/125.8 |
| 6,558,295 | B2 * | 5/2003 | Araki et al. | 482/35 |
| 2002/0010054 | A1 * | 1/2002 | Araki et al. | 482/35 |

* cited by examiner

*Primary Examiner* — Loan H Thanh
*Assistant Examiner* — Gary D Urbiel Goldner
(74) *Attorney, Agent, or Firm* — The Marbury Law Group, PLLC

(57) ABSTRACT

There is provided a household jungle gym 10 including a swing space 200 which is formed continuously with a lateral side of a frame structure 100, a swing supporting shaft 21 which is detachably stretched in the swing space 200, a triangular supporting portion 40 which pivotally supports the swing supporting shaft 21, strut pipes 41 which support the triangular supporting portion 40, and two telescopic pipes 30 which are disposed parallel to each other on a floor surface and which each have a double rod construction so as to be telescopic, wherein when the jungle gym 10 is stowed, by dismounting the swing 20 and the swing supporting shaft 21 and causing the two telescopic pipes 30 to slide, the triangular supporting portion 40 and the strut pipes 41 can be moved extremely close to the frame structure 100.

4 Claims, 13 Drawing Sheets

(a)

(b)

(c)

HOUSEHOLD JUNGLE GYM

CROSS-REFERENCE TO RELATED APPLICATIONS

This application is based upon and claims the benefit of priority under 35 USC 119 of Japanese Patent Application No. 2010-282631 filed on Dec. 20, 2010, the entire contents of which, including the description, claims, drawings and abstract, are incorporated herein by reference.

BACKGROUND OF THE INVENTION

1. Field of the Invention

The present invention relates to a household jungle gym which is a playing tool with which infants play indoors and more particularly to a household jungle gym which incorporates a swing and a slide which can be dismounted so as to make the jungle gym compact for easy stowage.

2. Description of the Related Art

Conventionally, household jungle gyms with which infants play indoors include those in which pipe members are joined together by joints so as to be assembled into a solid or three-dimensional grid-like structure. In addition, for example, Japanese Unexamined Utility Model Publication No. 5-15968, which constitutes Patent Document 1, discloses a household jungle gym which includes a swing which is integrated therewith.

The household jungle gym disclosed in Patent Document 1 has a difficulty in finding a stowage space due to the jungle gym being a large playing tool. In addition, this jungle gym requires a length of time to be built up or stowed. Therefore, mothers having infants have had a difficulty in assembling components into the jungle gym for use or disassembling it to pieces for stowage.

SUMMARY OF THE INVENTION

The invention has been made in view of the problems inherent in the related art, and an object thereof is to provide a household jungle gym which can be simply stowed as a compact jungle gym when not in use and which can satisfy infants' interests in playing sufficiently when in use.

According to a first aspect of the invention, there is provided a household jungle gym which is a household jungle gym which can be played with indoors, including a three-dimensional grid-like frame structure which is built up by joining pipe members together with joints as a main body portion, a swing which can be dismounted, a swing space which is formed continuously with a lateral side of the frame structure as a swing suspension space, and a swing supporting shaft, strut pipes and telescopic pipes which define the swing space together, wherein the swing supporting shaft which is stretched to suspend the swing is mounted on the frame structure so as to be dismounted, wherein a triangular supporting portion which pivotally supports the swing supporting shaft is provided, wherein the triangular supporting portion is supported by the strut pipes, wherein the telescopic pipes are made up of two pipes which are connected to lower ends of the strut pipes, respectively, which are disposed parallel to each other on a floor surface and which each have a double rod construction so as to be telescopic, and wherein when the swing and the swing supporting shaft are dismounted for stowage, by causing the two telescopic pipes to slide, the triangular supporting portion and the strut pipes can be moved extremely close to the frame structure.

According to a second aspect of the invention, there is provided a household jungle gym as set forth in the first aspect, having a fixedly supporting portion which is placed on the frame structure in a position which faces the triangular supporting portion, wherein the swing supporting shaft is pivotally supported by the triangular supporting portion at one end and is pivotally supported by the fixedly supporting portion at the other end thereof.

According to a third aspect of the invention, there is provided a household jungle gym as set forth in the first aspect, wherein when dismounted, the swing is fixedly hooked on a pipe member of the frame structure.

According to a fourth aspect of the invention, there is provided a household jungle gym as set forth in the first aspect, wherein the telescopic pipes have locking mechanisms for fastening the telescopic pipes in in-use positions and non-in-use positions when the telescopic pipes are put in an in-use state and a non-in-use state.

According to a fifth aspect of the invention, there is provided a household jungle gym as set forth in the first aspect, further including a slide which is integrated with the frame structure and a staircase for the slide, wherein when the slide and the staircase are dismounted from in-use positions, the slide and the staircase can be fixedly hooked on pipe members of the frame structure.

According to the invention, the jungle gym can be made compact for stowage by the simple operation and can be deployed simply for use. Therefore, the household jungle gym can be provided which can be set up within a short period of time when an infant or child wants to play therewith so as to satisfy the infant's or child's interest in playing sufficiently at all times.

According to the household jungle gym of the invention, the swing supporting shaft which suspends the swing is fixed so as not to rotate by the triangular supporting portion and the fixedly supporting portion. Therefore, the swing can be swung safely.

In addition, according to the household jungle gym of the invention, the swing dismounted can be fixedly hooked on the pipe member of the frame structure. Thus, the swing can be stowed together with the frame structure, and therefore, the loss of the swing can be prevented.

Further, according to the household jungle gym of the invention, the telescopic pipes have the locking mechanisms which can fasten the telescopic pipes in the in-use positions and the non-in-use positions when the telescopic pipes are put in the in-use and non-in-use states. Therefore, there is caused no such situation that the telescopic pipes are caused to slide erroneously while in use, and hence, the jungle gym of the invention is safe.

Then, according to the household jungle gym of the invention, when dismounted from the in-use positions, the slide and the staircase can be fixedly hooked on the pipes of the frame structure, so that the jungle gym can be made compact in size. In addition, it is difficult to forget about where to stow the dismounted members, and hence, the loss of the members can be prevented.

DETAILED DESCRIPTION OF THE PREFERRED EMBODIMENT

Figure 1:
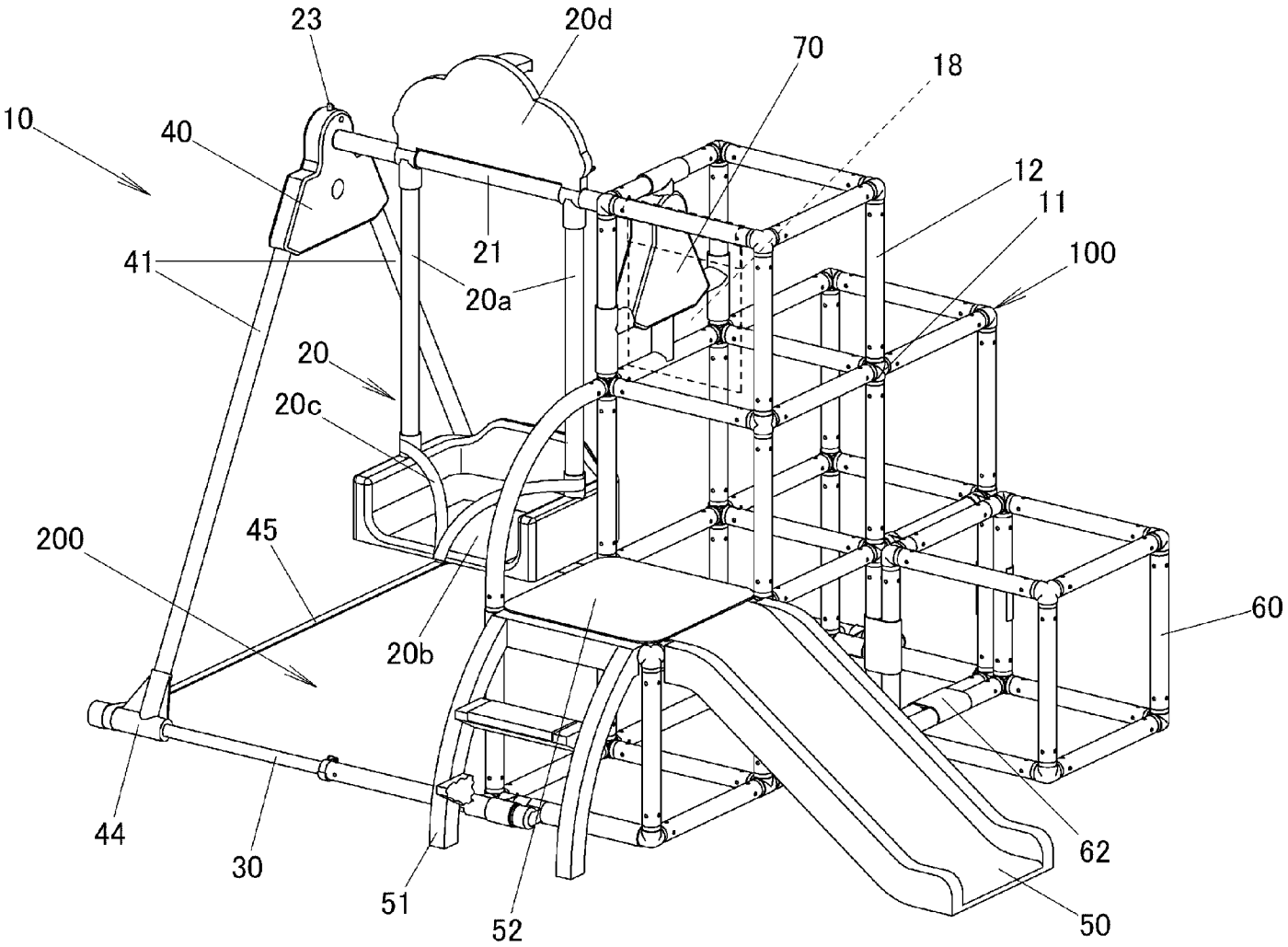
FIG. 1 is an external perspective view of a jungle gym according to an embodiment of the invention.

A mode for carrying out the invention will be described. A jungle gym 10 is a household jungle gym 10 which can be played with indoors. This jungle gym 10 is formed so that a three-dimensional grid-like frame structure 100 constitutes a main body portion, and the frame structure 100 is formed by joining pipes 12 which are pipe members together with jungle gym joints 11. Additionally, the jungle gym 10 includes a detachable swing 20 and a swing space 200 which is formed continuously with a lateral side of the frame structure 100 which is the main body of the jungle gym 10 as a suspension space for the swing 20.

Further, the jungle gym 10 includes a detachable swing supporting shaft 21 and a triangular supporting portion 40 which pivotally supports the swing supporting shaft 21. The swing supporting shaft 21 is stretched to suspend the swing 20 in the swing space 200. The jungle gym 10 includes strut pipes 41 which support the triangular supporting portion 40 and telescopic pipes 30. The strut pipes 41 are made up of two metallic pipes which are disposed so as to expand into an inverted V-like shape as they extend downwards from the triangular supporting portion 40. The telescopic pipes 30 are made up of two pipes which are integrated with strut supporting joints 44 which are provided at respective lower ends of the strut pipes 41 and which are disposed parallel to each other on a floor surface. The telescopic pipes 30 each have a double rod construction in which one rod is telescopically extendable from and contractible into the other rod.

In this jungle gym 100, when the swing 20 and the swing supporting shaft 21 are dismounted, by slidingly contracting the two telescopic pipes 30, the triangular supporting portion 40 and the strut pipes 41 can be moved to approach the frame structure 100.

The swing supporting shaft 21 is pivotally supported by the triangular supporting portion 40 at one end and is pivotally supported by the fixedly supporting portion 70 at the other end. The fixedly supporting portion 70 is placed on the frame structure 100 in a position which faces the triangular supporting portion 40.

Further, the swing 20 is dismounted from the position where the swing 20 is suspended for use and is fixedly hooked on a pipe member of the frame structure 100.

The jungle gym 10 also has locking mechanisms which fasten the corresponding telescopic pipes 30 in predetermined positions when the telescopic pipes 30 are in use and not in use, respectively.

Additionally, the jungle gym 10 includes a slide 50 and a staircase 51 for the slide 50. The slide 50 is integrated with the frame structure 100. When the slide 50 and the staircase 51 are not in used, the slide 50 and the staircase 51 are fixedly hooked on pipe members of the frame structure 100.

Hereinafter, an embodiment of the invention will be described by reference to the drawings.

A jungle gym 10 is a household jungle gym 10 which can be played with indoors. This jungle gym 10 is a jungle gym 10 for infants or children, including a frame structure 100. This frame structure 100 constitutes a main body portion which can be formed into various shapes by connecting pipes 12 which are a plurality of pipe members together with jungle gym joints 11 vertically and horizontally as required.

When front and rear are referred to with respect to the jungle gym 10 of the embodiment, a front side of a swing 20 in FIG. 1 is referred to as a front or forward direction, and a rear side as a rear or rearward direction. In addition, when left and right are referred to with respect to the jungle gym 10 of the embodiment, left and right directions with respect to the jungle gym 10 are directions which horizontally intersect the forward direction at right angles.

The jungle gym 10 includes a swing 20, a slide 50, a staircase 51, a top step panel 52, a curtain 18, an independent cubical structure 60 and members for suspending the swing 20 in a swing space 200 which is a space for placing the swing 20.

Pipes 12 are made from synthetic resin and are all formed into a straight cylindrical shape which is about 285 mm long and about 32 mm thick in outside diameter. In this way, by forming the pipes 12 to the same length, the pipes 12 can be disposed freely in various positions in the jungle gym 10 so that the jungle gym 10 can be formed into arbitrary shapes. In addition, the jungle gym 10 also has pipes which are curved into an arc shape which is suitable to be used for a handrail and the like.

Figure 2:
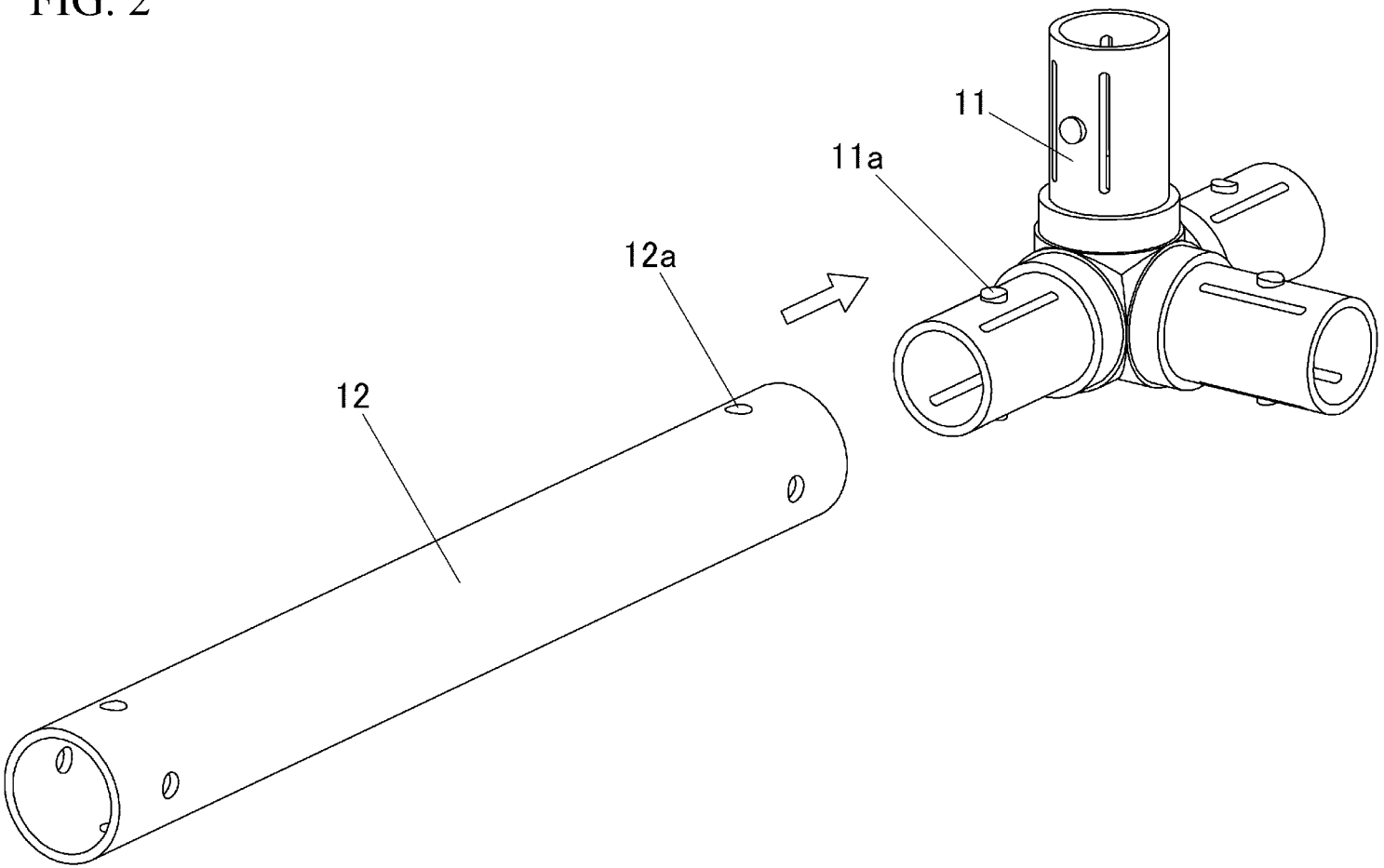
FIG. 2 is an explanatory diagram illustrating an attaching operation of a pipe to a joint of the jungle gym according to the embodiment of the invention.

In addition, as is shown in FIG. 2, four pipe holes 12*a* are formed at equal intervals in a circumferential direction in the vicinity of each of end portions of the pipe 12 so that the pipe holes can fit on joint projecting portions 11*a* which are provided on jungle gym joints 11.

Specifically speaking, these four pipe holes 12*a* penetrate the pipe 12 from inside to outside in four directions which are at right angles to each other. In addition, in the straight pipe 12, a line connecting the center of the pipe hole 12*a* at one end and the center of the pipe hole 12*a* at the other end is disposed so as to be parallel to a central axis of the pipe 12.

Namely, when the jungle gym joint 11 is inserted into the pipe 12, the joint projecting portions 11*a* of the jungle gym joint 11 fit in the pipe holes 12*a* in the pipe 12, whereby the pipe 12 is attached to the jungle gym joint 11. By connecting the pipes 12 together horizontally and vertically with the jungle gym joints 11, the jungle gym 10 can be formed which has a well balanced main body portion.

The jungle gym joint 11 is made from a synthetic resin such as polypropylene which is relatively light in weight, which is strong and rigid and which is so soft as to have a superior flexural fatigue strength. Thus, the pipe 12 can detachably be attached to the jungle gym joint 11.

There are a plurality of kinds of jungle gym joints 11, including a first joint, not shown, in which joint axes branch into three directions, a second joint in which joint axes branch into four direction, a third joint in which joint axes branch into five directions and a fourth joint in which joint axes branch into six directions.

Figure 3:
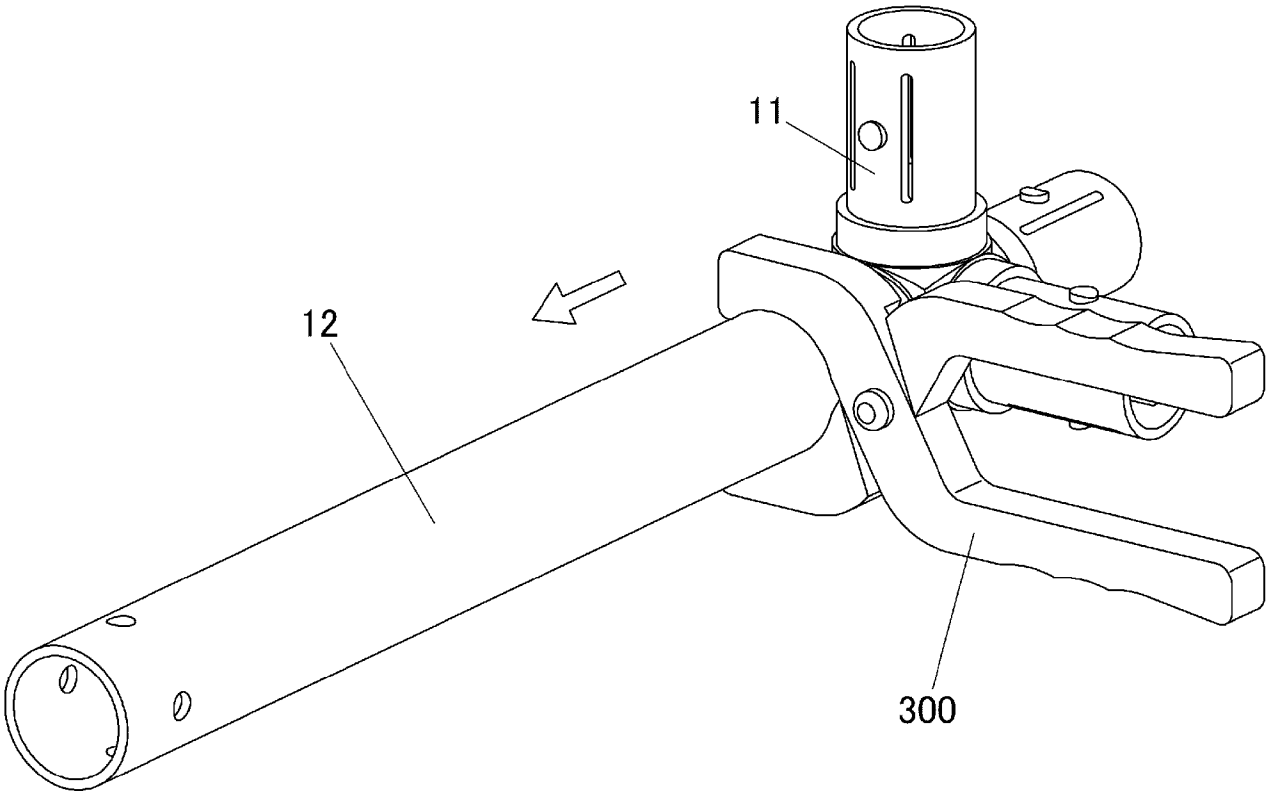
FIG. 3 is an explanatory diagram illustrating a detaching operation of the pipe from the joint of the jungle gym according to the embodiment of the invention.

This jungle gym 10 is sold as being disassembled into pieces or as a kit into which a predetermined number of jungle gym joints 11, a predetermined number of pipes 12, a removing tool 300 like pincers which is used to remove the pipe 12 from the jungle gym joint 11 as is shown in FIG. 3, a slide 50, a swing 20, a staircase 51, a top step panel 52 and accessories like a curtain 18 are packaged.

Figure 4:
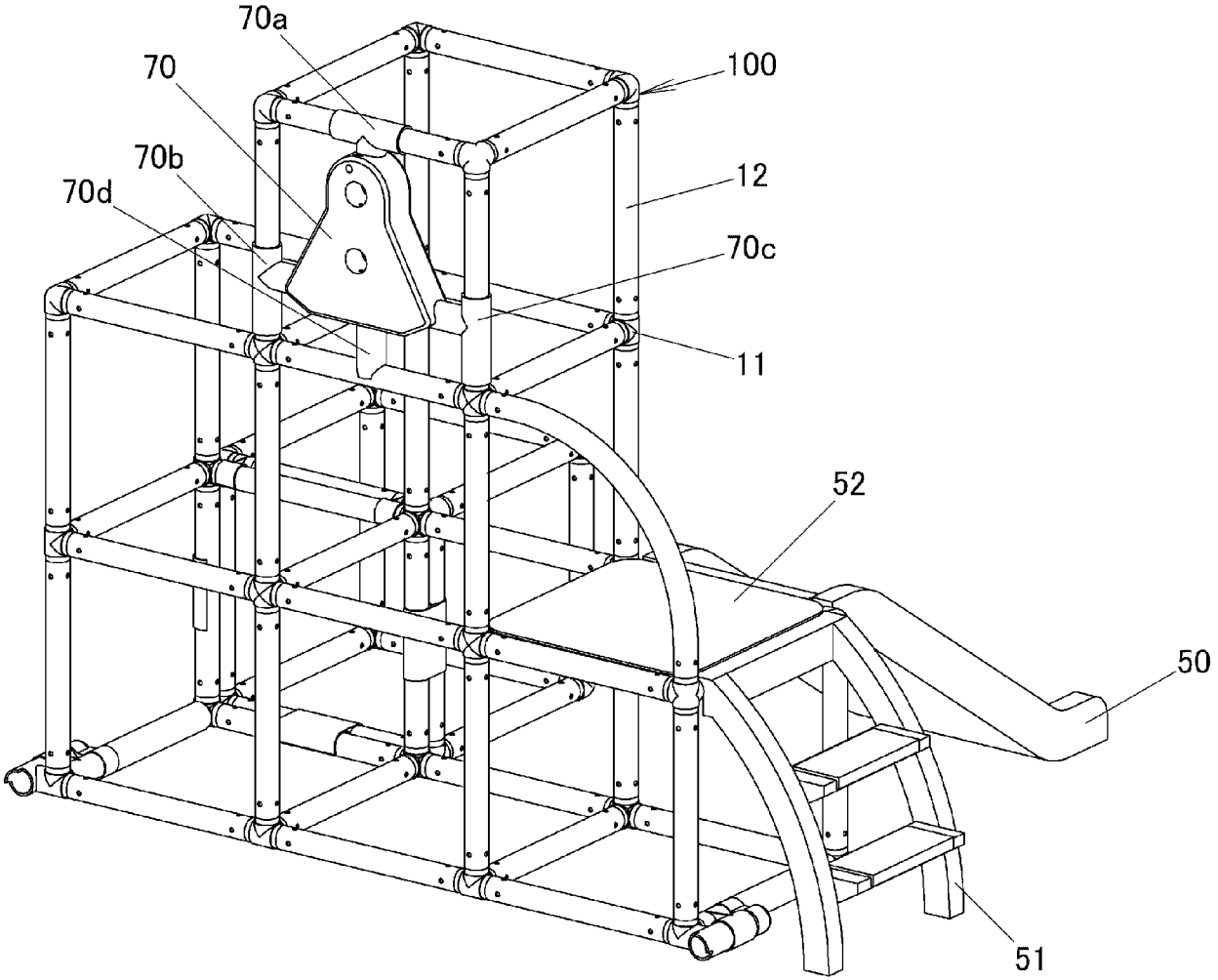
FIG. 4 is an explanatory diagram of a fixedly supporting portion of the jungle gym according to the embodiment of the invention.

The jungle gym 10 into which the constituent components listed above are assembled includes in the swing space 200, as shown in FIG. 1, two strut supporting joints 44 which are connected to telescopic pipes 30, strut pipes 41 which are made up of two metallic pipes which are disposed so as to expand into an inverted V-like shape as they extend downwards, and a right-hand supporting portion which is formed by a triangular supporting portion 40 which is disposed at an apex portion of the strut pipes 41. In addition, the jungle gym 10 also includes a left-hand supporting portion which is formed by a fixedly supporting portion 70 as shown in FIG. 4 at a portion of the frame structure 100 in a position facing the triangular supporting portion 40 across the swing space 200.

The fixedly supporting portion 70 has in four locations along the circumference thereof an upper engagement portion 70*a*, a lower engagement portion 70*d*, a front engagement portion 70*c* and a rear engagement portion 70*b* at which the fixedly supporting portion 70 is fixed to the pipes 12 of the frame structure 100. Namely, the fixedly supporting portion 70 is held in predetermined positions on the frame structure 100 via the engagement portions disposed in the four locations along the circumference thereof.

The upper engagement portion 70*a* includes a pipe engagement portion into which a horizontal pipe 12 of the frame structure 100 which is positioned above the fixedly supporting portion 70 is inserted so that the fixedly supporting portion 70 is connected to the horizontal pipe 12. The lower engagement portion 70*d* includes an engagement portion having a circular recess portion which is brought into engagement with an upper circumferential surface of a horizontal pipe 12 of the frame structure 100 which is positioned below the fixedly supporting portion 70. The front engagement portion 70*c* includes a pipe engagement portion into which a vertical pipe 12 of the frame structure 100 which is positioned at the front of the fixedly supporting portion 70 is inserted so that the fixedly supporting portion 70 is connected to the vertical pipe 12. The rear engagement portion 70*b* includes a pipe engagement portion into which a vertical pipe of the frame structure 100 which is positioned at the rear of the fixedly supporting portion 70 is inserted so that the fixedly supporting portion 70 is fixed to the vertical pipe 12.

In addition, a swing supporting shaft 21 is stretched in an upper portion in the swing space 200 so as to be supported at the left- and right-hand supporting portions so that the swing 20 is suspended from the swing supporting shaft 21. Further, the two strut supporting joints 44 are connected together by a resin band 45 in a lower portion in the swing space 200.

The swing supporting shaft 21 is pivotally supported by the triangular supporting portion 40 at one end and is pivotally supported by the fixedly supporting portion 70 at the other end thereof. The swing supporting shaft 21 is pivotally supported at the triangular supporting portion 40 and the fixedly supporting portion 70 so as not to rotate by inserting rotation preventive pins 23 through predetermined holes which are provided in the swing supporting shaft 21.

A seat 20*b* of the swing 20 is formed from a resin material through one-piece molding. Wall portions are erected along left- and right-hand side portions and a rear side portion of a bottom plate of the seat 20*b* so that one infant or child can be seated in the seat 20*b*.

Seat suspension pipes 20*a* are fixedly screwed to the seat 20*b* with screws, not shown, at upper portions of the left- and right-hand wall portions of the seat 20*b*. In addition, upper ends of the seat suspension pipes are screwed to a swing suspension panel 20*d* into which the swing supporting shaft 21 is inserted with screws, not shown. A safety belt 20*c* is provided on the seat 20*b*.

Next, a process of dismounting the constituent components from the positions on the jungle gym 10 where they are located when in use for stowage will be described.

When stowing the jungle gym 10, firstly, the swing supporting shaft 21 and the swing 20 are dismounted. Further, the slide 50, the staircase 51 and the top step panel 52 are dismounted.

Figure 5:
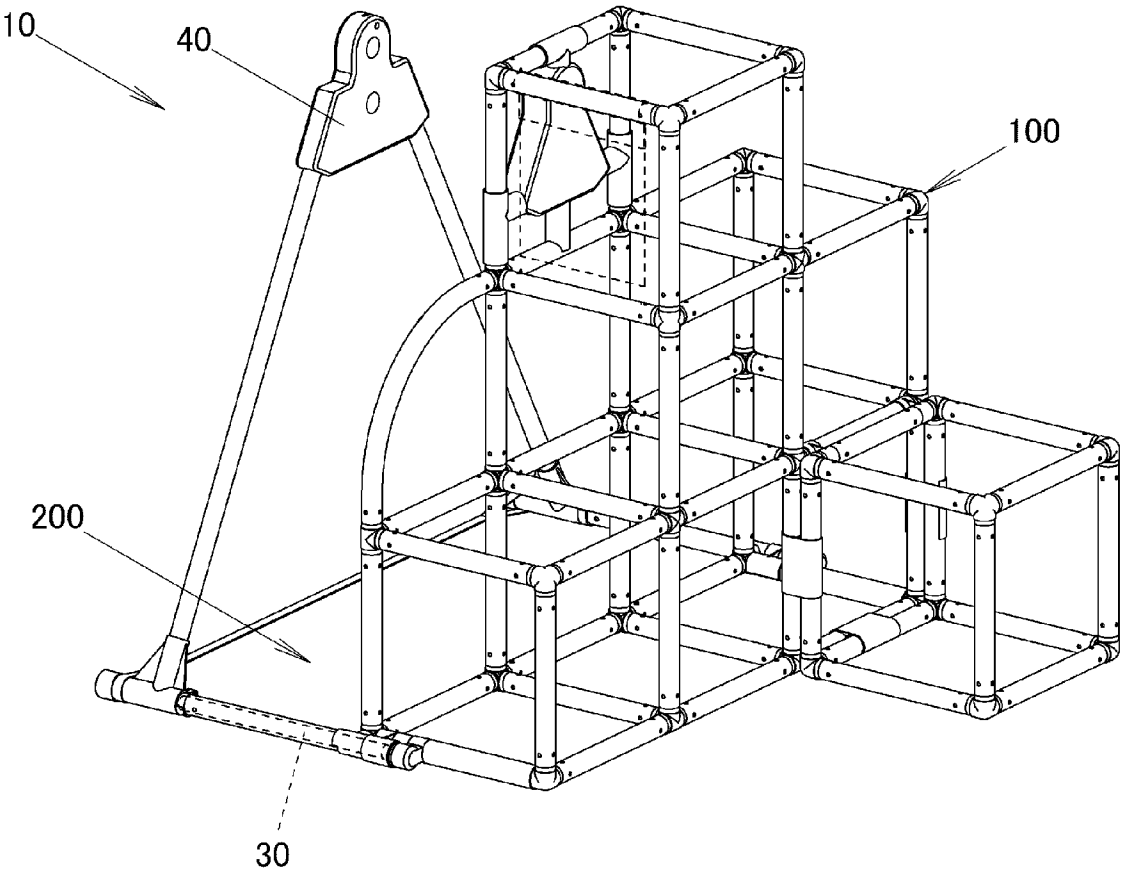
FIG. 5 is an external perspective view of the jungle gym according to the embodiment of the invention, illustrating a stowing process thereof.

Then, in the jungle gym 10, in the swing space 200, as shown in FIG. 5, the telescopic pipes 30 which are positioned at a bottom portion of the swing space 200 are contracted towards the frame structure 100 so that the right-hand supporting portion is caused to approach a circumferential edge of the frame structure 100. Further, when the telescopic pipes 30 are caused to slide, the right-hand supporting portion can be disposed so as to be attached to a lateral side portion of the frame structure as shown in FIG. 6.

Next, for example, a cubical structure 60 which can be detachably attached to the frame structure 100 is dismounted from a position on the frame structure 100 where the cubical structure 60 is attached for use when the jungle gym 10 is played with and is then disposed in an L-shaped recess portion formed in an upper portion of the frame structure 100. Then, a pipe of pipes of the cubical structure 60 and a pipe 12 of the pipes 12 of the frame structure 100 which are disposed closest to each other are fastened together by detachable connecting members 62 which are detachable to fasten together a pipe of the pipes of the cubical structure 60 and a pipe 12 of the pipes of the frame structure 100 which are disposed closest to each other.

Figure 6:
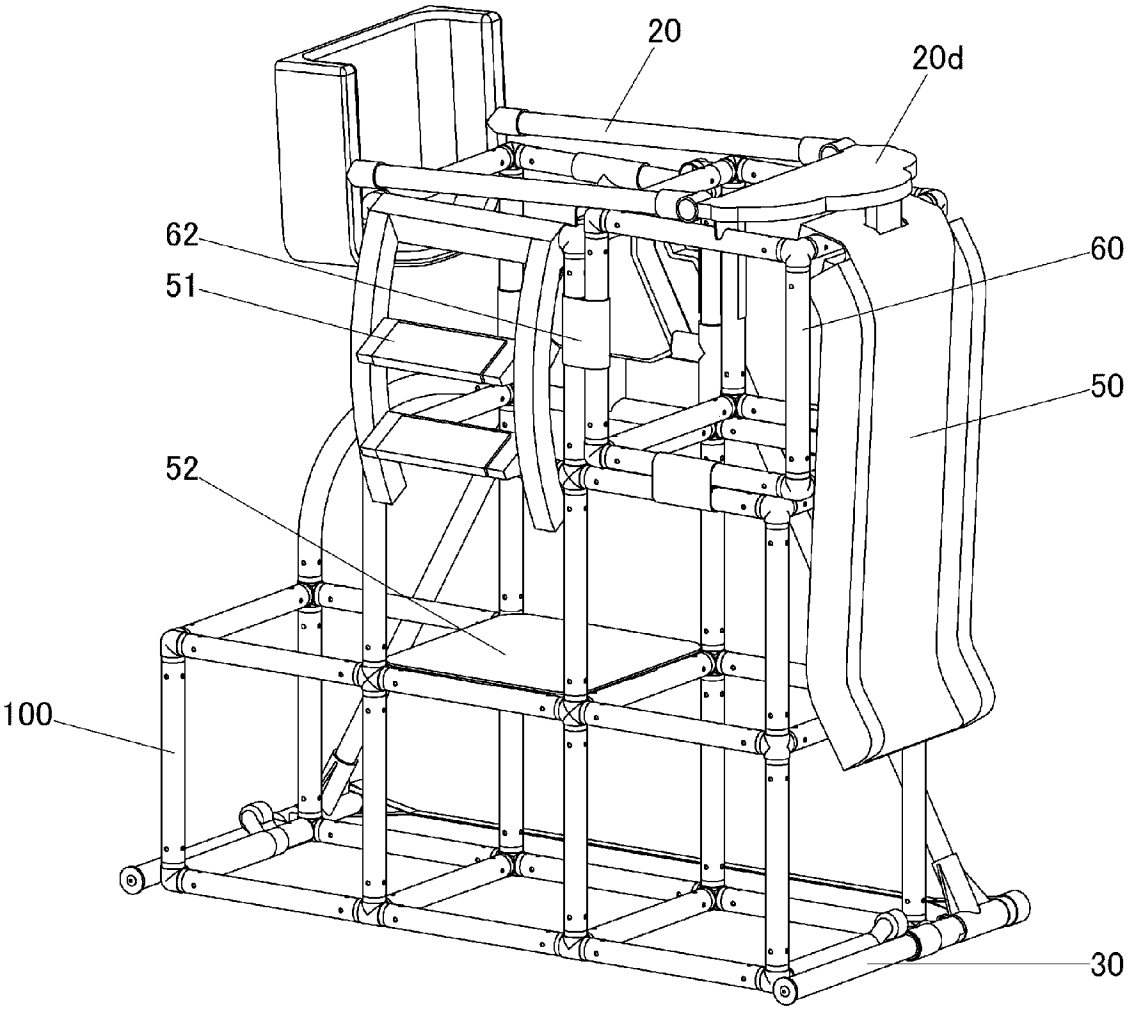
FIG. 6 is an external perspective view of the jungle gym according to the embodiment of the invention, illustrating constituent parts stowed in predetermined positions for stowage of the jungle gym itself.

Next, the slide 50 which has already been dismounted is placed on the jungle gym 10 so as to be suspended therealong by hooking a pipe hook portion of the slide 50 which has already been dismounted on, for example, onto an uppermost pipe 12 on a short-side lateral side of the frame structure 100 which is the main body portion of the jungle gym 10 as shown in FIG. 6.

In addition, the staircase 51 which has already been dismounted is placed on the jungle gym 10 so as to be suspended therealong by hooking a pipe hook portion of the staircase 51 which has already been dismounted on, for example, onto an uppermost pipe 12 on a long-side lateral side of the frame structure 100 which is the main body portion of the jungle gym 10. The top step panel 52 is placed in a hooked fashion on any of horizontal planes which are formed in an interior of the frame structure 100 by four pipes 12.

Then, the swing 20 which has already been dismounted is placed on an uppermost surface of the frame structure 100 on which the slide 50, the staircase 51 and the top step panel 52 are hooked in the predetermined positions for stowage. Specifically speaking, the swing 20 is placed so as to lie on the uppermost surface of the frame structure 100. Then, a projecting portion on the swing suspension panel 20*d* which is positioned at an upper portion of the swing 20 is inserted into a rectangular hole formed in the slide 50 in the vicinity of the pipe hook portion of the slide 50 which is now hooked as is shown in FIG. 6. Thus, the swing 20 is placed so as to cover the uppermost surface of the frame structure 100.

The jungle gym 10 is such that the pipes 12, which are pipe members, are joined together freely by the jungle gym joints 11 into the three-dimensional grid-like frame structure 100 which can be freely formed into various shapes. Thus, the shape of the frame structure 100 which constitutes the main body portion of the jungle gym 100 is not limited to the shapes shown in FIGS. 1, 4 and 5.

Figure 7:
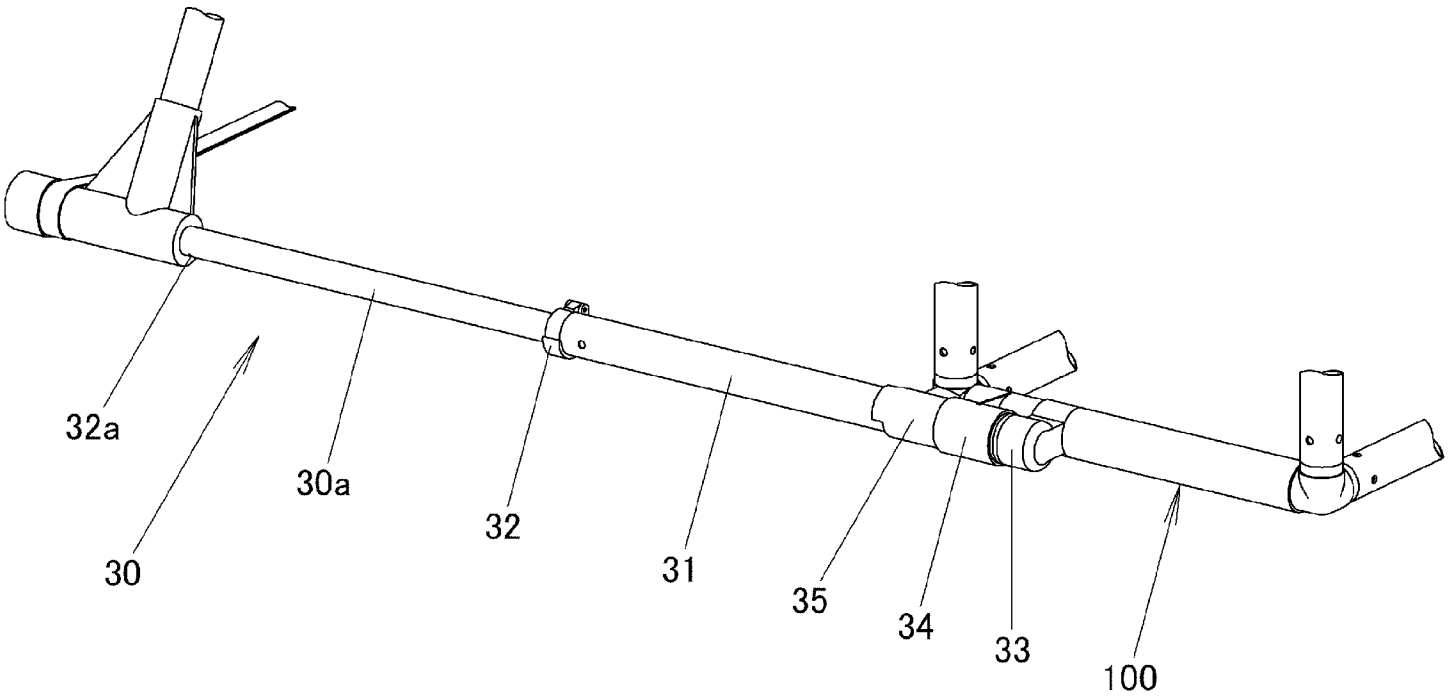
FIG. 7 is an explanatory diagram illustrating the configuration of a telescopic pipe of the jungle gym according to the embodiment of the invention.

Here, the configuration of the telescopic pipes 30 of the jungle gym 10 will be described in detail by use of the drawings. FIG. 7 is an explanatory diagram illustrating the configurations of respective constituent portions of the telescopic pipe 30 which is deployed.

The telescopic pipe 30 of the jungle gym 10 includes, as is shown in FIG. 7, a metallic floor pipe 30*a* and a resin stowing pipe 31. The telescopic pipe 30 has a floor pipe lock 32 which functions as a locking mechanism. In addition, the frame structure 100 has a slide stopper 33 and a stowing pipe connecting member 34 which are disposed in the vicinity of the telescopic pipe 30.

The floor pipe lock 32 is placed at a distal end side (a right-hand side) of the stowing pipe 31 and has a hook portion which has a projection 32*d* (refer to FIG. 8) which connects the floor pipe 30*a* and the stowing pipe 31 together. The hook portion of the floor pipe lock 32 is locked in a notched engagement hole 32*a* provided at a distal end side (a right-hand side) of the floor pipe 30*a* when the floor pipe 30*a* is stowed. When the floor pipe 30*a* is deployed, the hook portion of the floor pipe lock 32 is locked in a notched engagement hole, not shown, which is provided at a rear end side (a left-hand side) of the floor pipe 30*a* which is positioned within the stowing pipe 31.

Figure 9:
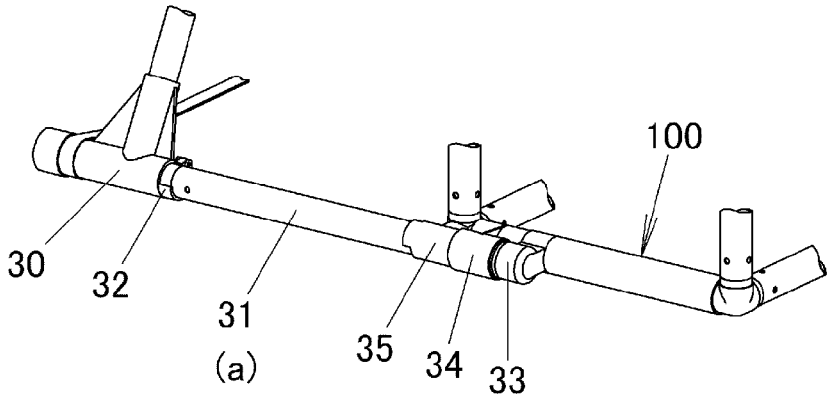
FIGS. 9 (*a*), (*b*) and (*c*) show further explanatory diagrams illustrating the locking mechanism of the telescopic pipe according to the embodiment of the invention.
Figure 9:
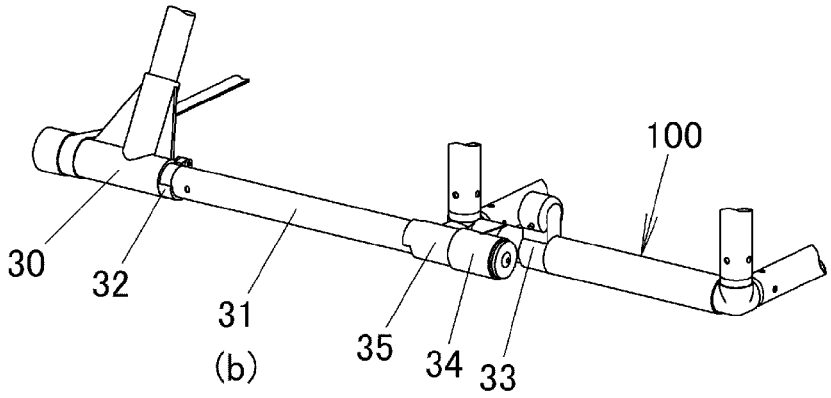
Figure 9:
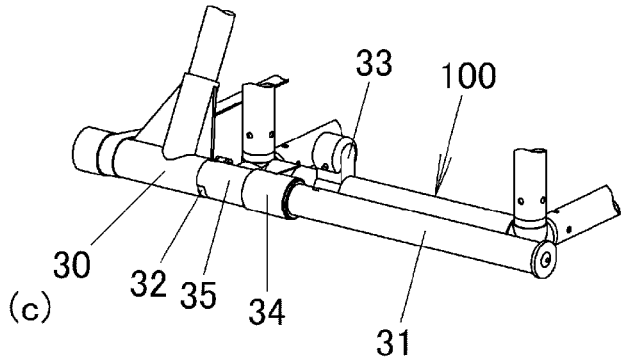

The slide stopper 33, which functions as a locking mechanism, is integrated with the frame structure 100 in the vicinity of a swing space joint 35, which will be described later, and has a stopper portion which can rotate through about 180 degrees. When the telescopic pipe 30 is deployed, the stopper portion is rotated to a rear end side of the stowing pipe 31 so as to be disposed in a position lying on an extension of a central axis of the stowing pipe 31 as is shown in FIG. 9, whereby the telescopic pipe 30 is fixed in place.

The stowing pipe connecting member 34 is disposed in the vicinity of the swing space joint 35 and has a substantially semi-cylindrical hook portion which can rotate as a connecting portion. The hook portion of the stowing pipe connecting member 34 locks a circumferential portion at a distal end of the stowing pipe 31 when stowed so that the stowing pipe 31 and the swing space joint 35 are connected together. On the other hand, when deployed, the hook portion of the stowing pipe connecting member 34 locks a circumferential portion at a rear end of the stowing pipe 31 so as to connect the stowing pipe 31 and the swing space joint 35 together.

The swing space joint 35 is a jungle gym joint which is disposed in a lower end corner portion of the left-hand supporting portion of the frame structure 100. Joint axes along which the pipes 12 are joined branch into three directions, so that the pipes are attached to the joint in three directions. In addition, the swing space joint 35 has a hollow cylindrical guide portion in front of the joint axis, so that the telescopic pipe 30 can be caused to slide in an axial direction by allowing the telescopic pipe 30 to be inserted into the hollow cylindrical guide portion.

Figure 8:
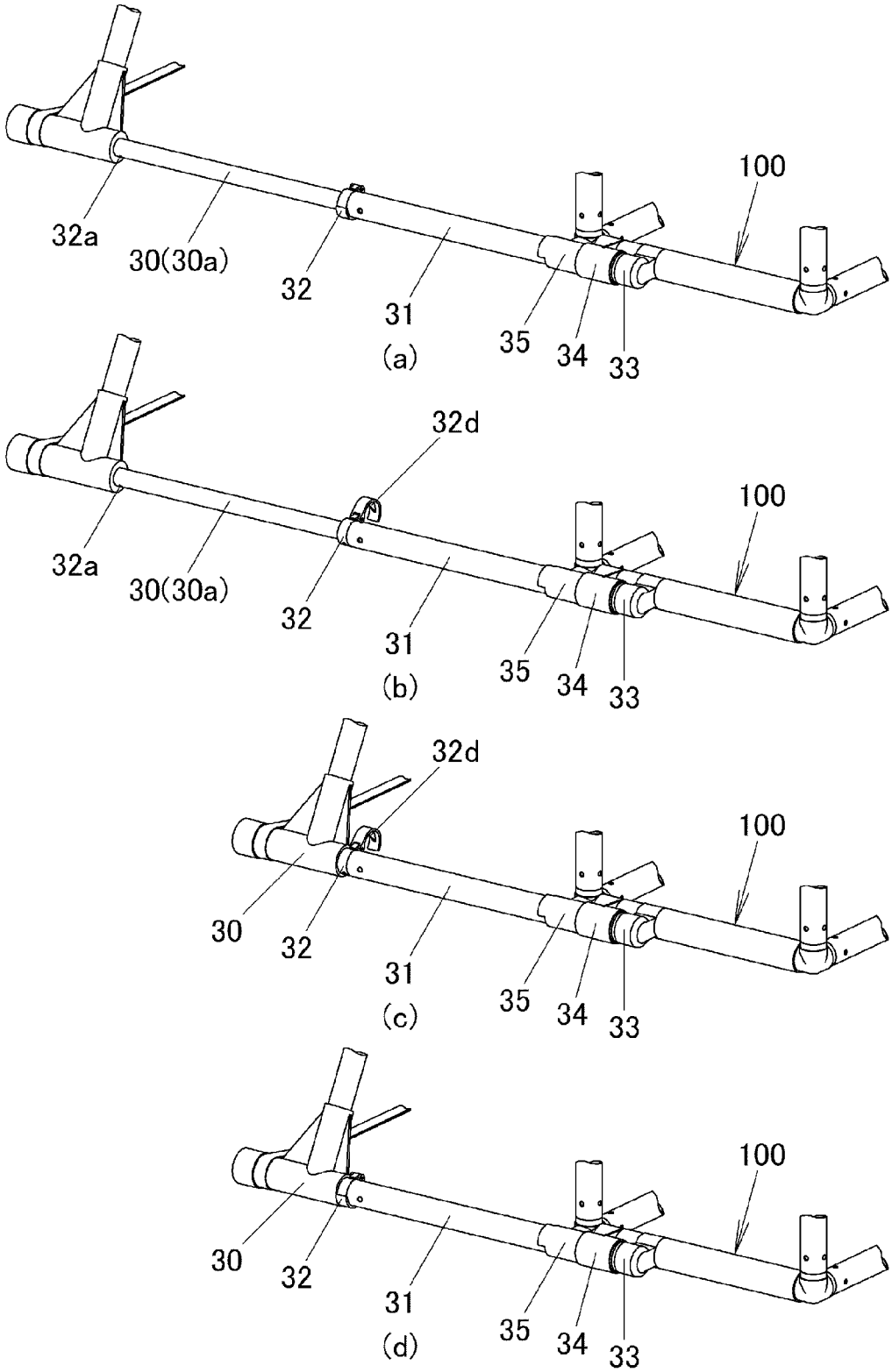
FIGS. 8 (*a*), (*b*), (*c*) and (*d*) show explanatory diagrams illustrating a locking mechanism of the telescopic pipe according to the embodiment of the invention.
Figure 10:
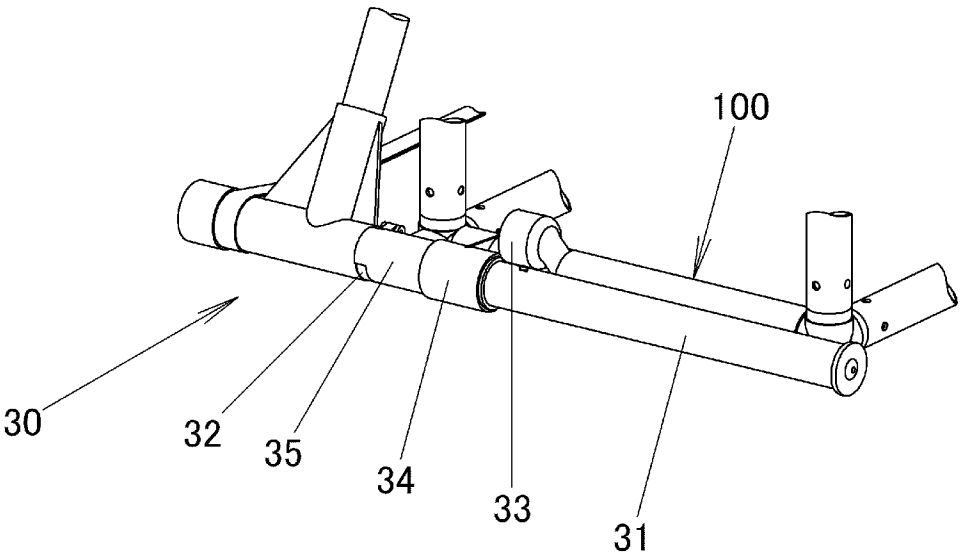
FIG. 10 is an explanatory diagram illustrating a state in which the telescopic pipe according to the embodiment of the invention is slid to be stowed.

Here, a series of steps of unlocking the locking mechanism of the telescopic pipe 30 will be described by use of the drawings. FIGS. 8 and 9 show explanatory diagrams illustrating a series of steps of unlocking the locking mechanism of the telescopic pipe 30. Further, FIG. 10 is an explanatory diagram illustrating the configurations of the constituent components when the telescopic pipe 30 is stowed.

In the telescopic pipe 30, firstly, the hook portion having the projection 32*d* provided inside the substantially semi-circular shape of the floor pipe lock 32 is opened as shown in FIG. 8(*b*) from a state shown in FIG. 8(*a*) in which the telescopic pipe 30 is deployed, so that the engagement with the notched engagement hole, not shown, at the rear end is released, whereby the engagement of the floor pipe lock 32 with the floor pipe 30*a* via the projection 32*d* is released.

Consequently, the floor pipe 30*a* is slid towards the stowing pipe 31 so that the telescopic pipe 30 can be contracted. Then, the telescopic pipe 30 is caused to slide until the floor pipe 30*a* is stopped at the end of the stowing pipe 31 as shown in FIG. 8(*c*), so that the floor pipe 30*a* can be stowed so as to be embedded in the stowing pipe 31.

In the telescopic pipe 30, in such a state that the floor pipe 30*a* is embedded in the stowing pipe 31, the hook portion of the floor pipe lock 32 having the substantially semi-circular projection 32*d* is brought into engagement with the notched engagement hole 32*a* at the distal end of the floor pipe 30*a* as shown in FIG. 8(*d*), so that the projection of the floor pipe 30*a* which is embedded within the stowing pipe 31 is prevented, whereby the floor pipe 30*a* is held in the embedded state.

Following this, in the telescopic pipe 30, the slide stopper 33 is rotated through 90 degrees upwards as shown in FIG. 9(*b*) in a state shown in FIG. 9(*a*) in which the floor pipe 30*a* is embedded within the stowing pipe 31, so that the locking at the rear end of the stowing pipe 31 is released, whereby the stowing pipe 31 is allowed to slide in the stowing direction.

In addition, the telescopic pipe 30 is caused to slide until it is stopped in the stowing direction as shown in FIG. 9(*c*), so that the stowing pipe 31 and the swing space joint 35 which is placed in the corner of the frame structure 100 which constitutes the main body portion of the jungle gym 10 are connected together to be fixed in place. Thus, the telescopic pipe 30 is disposed so as to follow parallel to a circumferential edge of the frame structure 100 as shown in FIG. 10.

When the telescopic pipe 30 is stowed, the right-hand supporting portion is disposed so as to follow the frame structure 100. Then, with the telescopic pipe 30 so stowed, the floor pipe lock 32, which constitutes the aforesaid locking mechanism, and the stowing pipe connecting member 34 are brought into engagement with the stowing pipe 31 in the predetermined positions on the stowing pipe 31. Thus, the telescopic pipe 30 can be held in the stowed state.

Figure 11:
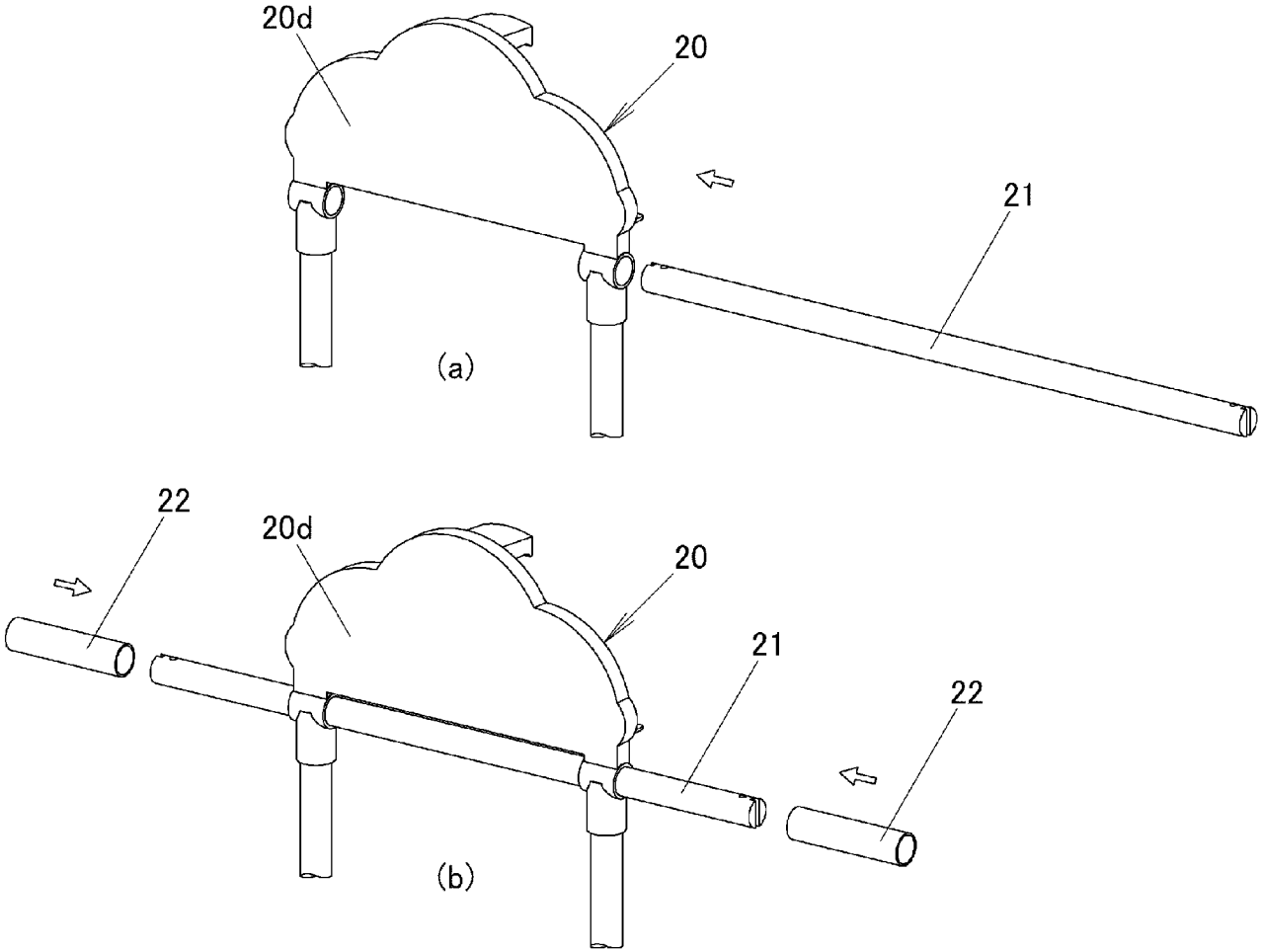
FIGS. 11 (*a*) and (*b*) show explanatory diagrams illustrating the mounting of a swing of the jungle gym according to the embodiment of the invention.
Figure 12:
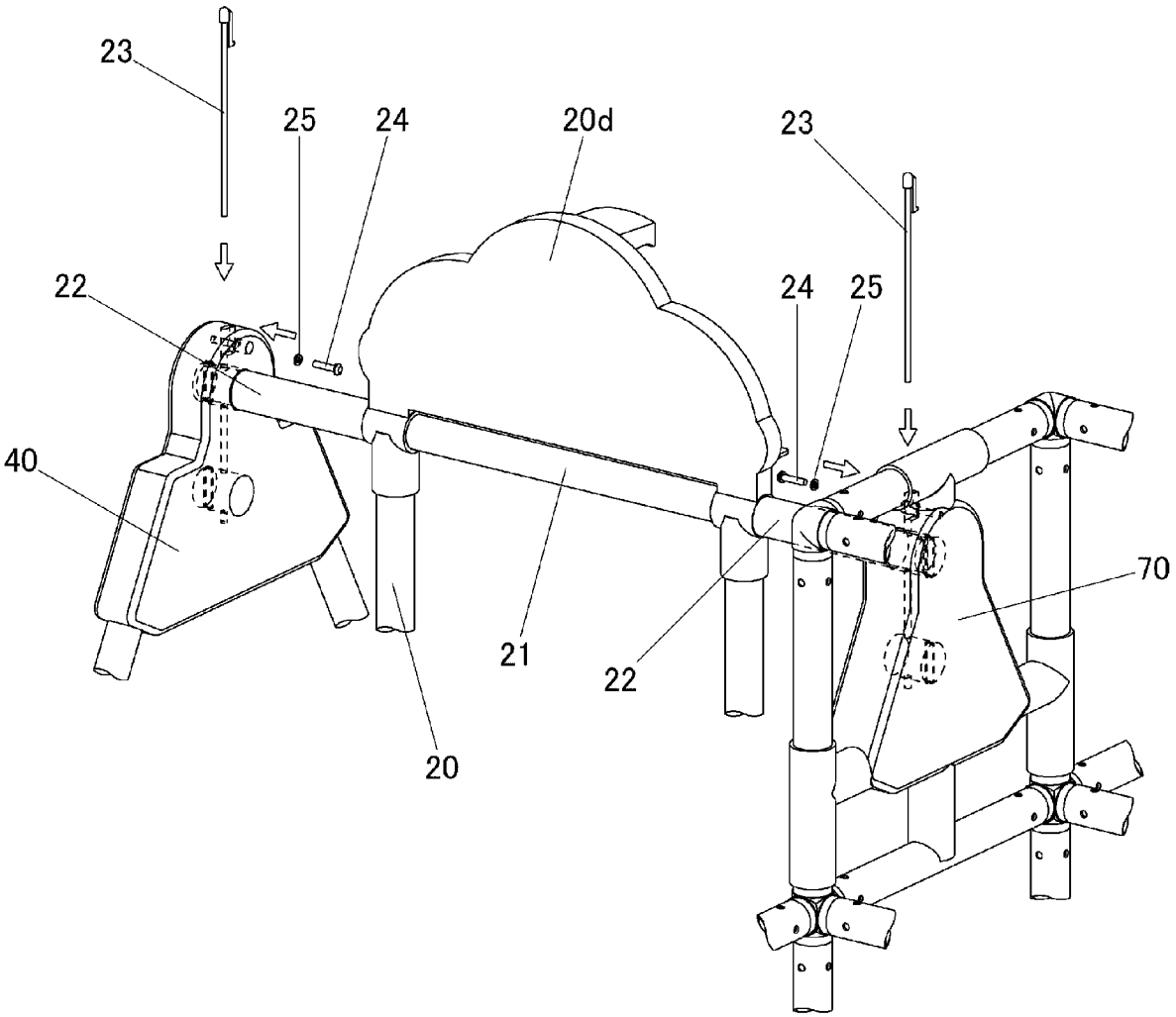
FIG. 12 shows explanatory diagram illustrating the mounting of a swing supporting shaft according to the embodiment of the invention.

Next, the mounting of the swing 20 in the jungle gym 10 will be described by reference to the drawings. FIG. 11 shows explanatory diagrams illustrating the mounting of the swing 20 and the swing supporting shaft 21. FIG. 12 is an explanatory diagram illustrating the mounting of the swing supporting shaft 21 on the triangular supporting portion 40 and the fixedly supporting portion 70 between which the swing supporting shaft 21 is stretched.

When mounting the swing 20 in the jungle gym 20, firstly, as shown in FIG. 11, the swing supporting shaft 21 is inserted through insertion holes which are provided at left- and right-hand sides of the swing suspension panel 20*d* of the swing 20. Then, Stoppers 22 for fixing a position of the swing 20 are respectively inserted into each of both ends of the swing supporting shafts 21 which are protruded outwards from the insertion holes. By disposing the stoppers 22 in that way, the swing 20 suspended can be swung without being offset in position leftwards or rightwards.

With the swing supporting shaft 21 being inserted into the swing 20 and the stopper 22 being inserted into the swing supporting shaft 21, Distal ends of the swing supporting shaft 21 is respectively fitted in predetermined fitting portions in the triangular supporting portion 40 and the fixedly supporting portion 70 in the swing space 200 as is shown in FIG. 12. Then, the rotation preventive pins 23 are inserted into the insertion holes for the rotation preventive pins 23 which are positioned in the upper portion of the triangular supporting portion 40 and in the upper portion of the fixedly supporting portion 70, respectively.

After the insertion of the rotation preventive pins 23, screws 24 and washers 25 as preventive stoppers for the rotation preventive pins 23 are respectively fastened to a predetermined position on each of the triangular supporting portion 40 and the fixedly supporting portion 70 so as to prevent the dislocation of the rotation preventive pin 23. This completes the mounting of the swing 20. When the swing 20 is dismounted, the screws 24 which are screwed into the predetermined positions and the washers 25 are dislocated, so that the rotation preventive pins 23 can be dislocated upwards, thereby making it possible to dismount the swing supporting shaft 21.

Figure 13:
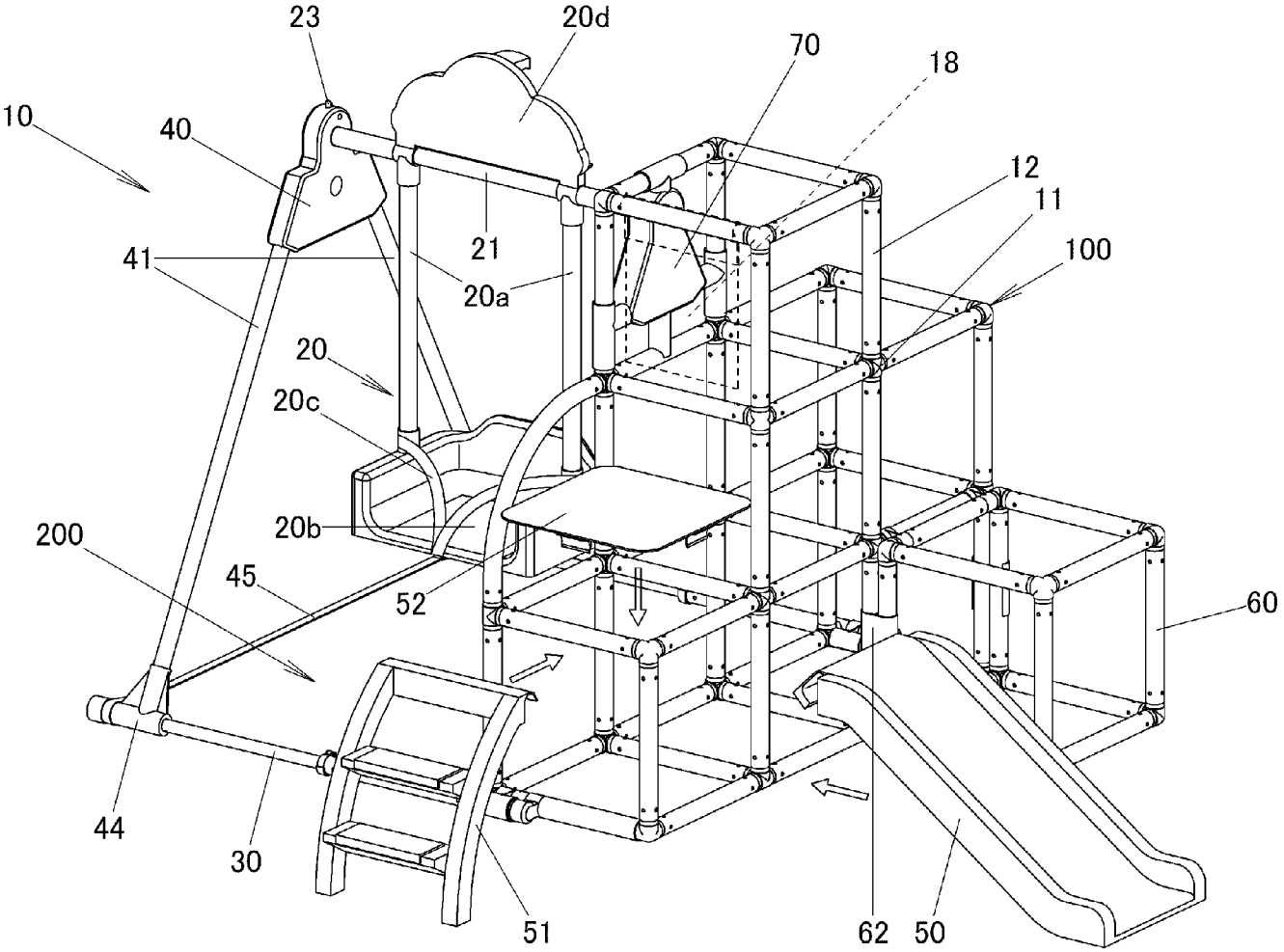
FIG. 13 is an explanatory diagram illustrating the mounting of a slide and a staircase of the jungle gym according to the embodiment of the invention.

Next, the mounting and dismounting of the slide 50, the staircase 52 and the top step panel 52 in and from the jungle gym 10 will be described by reference to the drawing. FIG. 13 is an explanatory diagram illustrating the mounting of the slide 50, the staircase 51 and the top step panel 52 on the frame structure 100.

As has been described before, the jungle gym 10 includes the slide 50 which can detachably be mounted on the frame structure 100, the staircase 51 which can detachably be mounted on the frame structure 100 and the top step panel 52 which can detachably be mounted on the frame structure 100. As is shown in FIG. 13, the slide 50 and the staircase 51 are hooked so as to be brought into engagement with the circumferential portions of the pipes 12 which make up the frame structure 100. Although the slide 50 and the staircase 51 are hooked on the frame structure 100 by being brought into engagement with the pipes 12 of the frame structure 100 as is shown in FIG. 1, by applying upward tensions thereto, the slide 50 and the staircase 51 which are in engagement with the corresponding pipes 12 are disengaged from the pipes 12 and the hooking of the slide 50 and the staircase 51 on the frame structure 100 is released, whereby the slide 50 and the staircase 51 can be dismounted from the hooked positions.

The top step panel 52 is made from resin and has a quadrangular shape. The top step panel 52 functions as a stepping place where an infant or child stands waiting for him or her to slide down the slide 50 after he or she has climbed up the staircase 51. The top step panel 52 is hooked so as to be fitted in a quadrangular portion defined by four pipes 12 on a predetermined horizontal plane in the frame structure 100. By applying an upward tension thereto, the hooking of the top step panel 52 on the predetermined horizontal plane is released, thereby making it possible to dismount the top step panel 52.

Thus, as has been described heretofore, according to the household jungle gym 10 of the invention, the jungle gym 10 can be stowed simply and compact, while when it is used, the jungle gym 10 can easily be deployed so as to form the swing space 200. Thus, when an infant or child wants to play therewith, the jungle gym 10 can be set up within a short period of time so as to satisfy the interest in playing of the infant or child sufficiently.

In addition, according to the household jungle gym 10 of the invention, the swing supporting shaft 21 is fixed so as not to rotate by the triangular supporting portion 40 and the fixedly supporting portion 70. Therefore, the swing 20 can be swung safely.

Additionally, according to the household jungle gym 10 of the invention, when the swing 20 and the swing supporting shaft 21 are dismounted so as to allow the telescopic pipes 30 to slide, the triangular supporting portion 40, the strut pipes 41 and the strut supporting joints 44 slide together with the telescopic pipes 30 and are then disposed so as to follow the circumferential edge of the frame structure 100. Thus, the household jungle gym 10 can be made compact in size so as to facilitate the stowage of the household jungle gym 10.

In addition, according to the household jungle gym 10 of the invention, the dismounted swing 20 is fixedly hooked on the pipe member of the frame structure 100, so that the swing 20 can be stowed together with the frame structure 100, thereby making it possible to prevent the loss thereof.

Further, according to the household jungle gym 10 of the invention, the respective telescopic pipes 30 include the locking mechanisms which lock the telescopic pipes 30 in the predetermined positions when they are deployed for use and are contracted for stowage. Therefore, there is caused no such situation in which the telescopic pipes 30 are caused to slide erroneously when in use, and thus, the jungle gym 10 is made safe.

Furthermore, according to the household jungle gym 10 of the invention, the slide 50 and the staircase 51 are fixedly hooked on the pipes 12 of the frame structure 100 when the jungle gym 10 is stowed. Therefore, the household jungle gym 10 can be made compact in size for stowage. In addition, the dismounted members are still placed on the jungle gym 10, and therefore, it is difficult to forget about where to stow the dismounted members, thereby making it possible to prevent the loss of the dismounted members.

The invention is not limited to the embodiment that has been described heretofore but can be altered, modified or improved freely without departing from the spirit and scope of the invention.

What is claimed is:

1. A household jungle gym which can be played with indoors, comprising:

a three-dimensional grid-like frame structure which is built up by joining pipe members together with joints as a main body portion;

a swing which can be dismounted; and a swing space which is formed continuously with a lateral side of the frame structure as a swing suspension space, and a swing supporting shaft, strut pipes and telescopic pipes which define the swing space together, wherein the swing supporting shaft which is positioned to suspend the swing is mounted on the frame structure so as to be dismounted, wherein a triangular supporting portion which supports the swing supporting shaft is provided, wherein the triangular supporting portion is supported by the strut pipes, wherein a fixedly supporting portion is placed on the frame structure in a position which faces the triangular supporting portion, wherein the swing supporting shaft is pivotally supported by the triangular supporting portion at one end and is pivotally supported by the fixedly supporting portion at the other end thereof, wherein the telescopic pipes are made up of two pipes which are connected to lower ends of the strut pipes, respectively, which are disposed parallel to each other on a floor surface and which each have a double rod construction which is made up of a floor pipe and a stowing pipe so as to be telescopic in such a way that the floor pipe is stowed into the stowing pipe and so that the stowing pipe can slide in an axial direction toward the joint of the frame structure for the swing space that is disposed at a lower end corner of the main body portion, and wherein when the swing and the swing supporting shaft are dismounted for stowage, by causing the two telescopic pipes to slide, the triangular supporting portion and the strut pipes can be moved adjacent to the frame structure.

2. The household jungle gym as set forth in claim 1, wherein when dismounted, the swing is fixedly hooked on at least one of the pipe members of the frame structure.

3. The household jungle gym as set forth in claim 1, further comprising a slide which is integrated with the frame structure and a staircase for the slide, wherein when the slide and the staircase are dismounted from in-use positions, the slide and the staircase can be fixedly hooked on the pipe members of the frame structure.

4. The household jungle gym as set forth in claim 2, further comprising a slide which is integrated with the frame structure and a staircase for the slide, wherein when the slide and the staircase are dismounted from in-use positions, the slide and the staircase can be fixedly hooked on the pipe members of the frame structure.

* * * * *